US006212930B1

(12) United States Patent
Skrabs et al.

(10) Patent No.: US 6,212,930 B1
(45) Date of Patent: Apr. 10, 2001

(54) METHOD AND DEVICE FOR PRODUCING STAMPED PARTS

(75) Inventors: Alfred Skrabs, Sitterswald (DE); Willy Grimm, Kallnach (CH)

(73) Assignee: ZF Friedrichshafen AG, Friedrichshafen (DE)

( * ) Notice: Subject to any disclaimer, the term of this patent is extended or adjusted under 35 U.S.C. 154(b) by 0 days.

(21) Appl. No.: 09/125,443

(22) PCT Filed: Mar. 5, 1997

(86) PCT No.: PCT/EP97/01093

§ 371 Date: Aug. 18, 1998

§ 102(e) Date: Aug. 18, 1998

(87) PCT Pub. No.: WO97/32678

PCT Pub. Date: Sep. 12, 1997

(30) Foreign Application Priority Data

Mar. 6, 1996 (DE) ..... 196 08 551

(51) Int. Cl.[7] ..... B21D 28/02
(52) U.S. Cl. ..... 72/336; 72/337
(58) Field of Search ..... 72/335–337, 339, 72/330, 329, 338

(56) References Cited

U.S. PATENT DOCUMENTS

| | | | | |
|---|---|---|---|---|
| 1,588,057 | * | 6/1926 | Ruckert | 72/336 |
| 2,305,064 | * | 12/1942 | Colwell | 72/336 |
| 3,635,067 | * | 1/1972 | Hanas | 72/336 |
| 4,800,745 | * | 1/1989 | Yokoyama | 72/336 |
| 5,346,044 | * | 9/1994 | Mohan | 72/379.2 |

FOREIGN PATENT DOCUMENTS

| | | | | |
|---|---|---|---|---|
| 2146606 | * | 3/1972 | (DE) | 72/336 |
| 06 234 027 | | 8/1994 | (JP) . | |
| 07 265 977 | | 10/1995 | (JP) . | |
| 219365 | * | 5/1968 | (SU) | 72/330 |
| 912388 | * | 3/1982 | (SU) | 72/330 |
| 1551464 | * | 3/1990 | (SU) | 72/335 |

OTHER PUBLICATIONS

Maschinenmarkt, "Stanz Prägen der Bohrungen an Stützplatten ersetzt herkömmliche Verfahren", by Johann Michael JOST, dated 1982, pp. 899–900.
Industrie, Nr. 26, vol. 29, dated 1985, p. 20.
Fertigung, "Ein guter Schnitt", dated Mar. 1987, pp. 64,66.
Maschinenmarkt,"Kleinserie rentabel", dated 1989, p. 34.
Feinschneiden, "Feinschnitteile im Automobilbau", dated Sep. 1990, pp. 88–90.

* cited by examiner

*Primary Examiner*—Daniel C. Crane
(74) *Attorney, Agent, or Firm*—Davis & Bujold, P.L.L.C.

(57) ABSTRACT

For producing stamped parts, especially plates, a method is proposed consisting of only two method steps. In a first method step the workpiece is fine blanked (2) inside a device (1) is then moved to a stamping stage (3) by means of transfer tongs (4) which are likewise housed in the device (1). The stamping stage (3) is also located inside the device (1). In a second method step, the inner and outer contours are stamped on the workpiece (5) in the stamping stage (3) in a manner such that the burrs produced on the workpiece (5) during the first step are removed.

4 Claims, 1 Drawing Sheet

METHOD AND DEVICE FOR PRODUCING STAMPED PARTS

Figure 1:
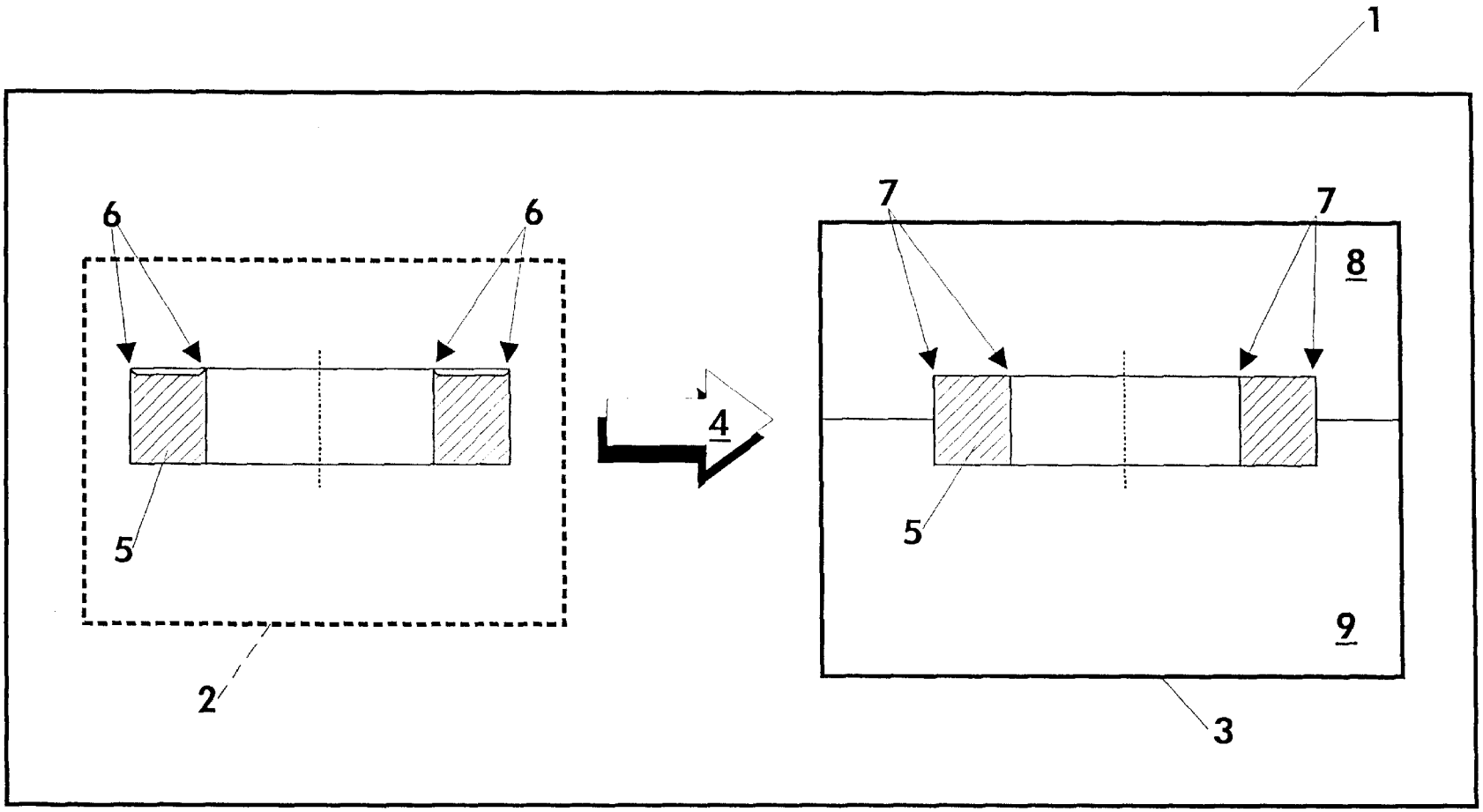

This application is a 371 of PCT/EP97/01093, filed Mar. 5, 1997.

The invention relates to a method and a device for producing stamped parts, especially plates.

BACKGROUND OF THE INVENTION

Stamped parts, especially plates such as used as clutch plates and brake plates in automatic transmissions, are customarily produced by the following steps: blanking, deburring, straightening and visual checking. In the blanking step the workpiece is blanked out from the raw material. In this step, burrs form in the outer and inner contours. The burrs are removed in the deburring step. In the straightening step, the workpiece is brought to a desired flatness by rolling, for example. The last mentioned method step is the visual checking. In the visual checking, the workpiece is checked for damage such as scratches or dents. Between these individual steps, the workpiece is removed from the respective tool, set in an intermediate position and transported to the next tool. By pretreating the raw material, the method steps can be reduced to blanking, deburring and visual checking. One kind of pretreatment is, for example, stress-relieving annealing. In the known production method, the elevated cost of production and the time taken are disadvantageous.

SUMMARY OF THE INVENTION

The invention solves the problem of reducing the cost of production and the time taken. According to the invention, the problem is solved by a method of production of stamped parts, especially plates, comprising only two steps. In a first step, the workpiece is blanked from raw material by fine blanking in a device and is the moved to a stamping stage by means of transfer tongs also housed in the device. The stamping stage is also inside the device. In the second step, the inner and outer contours of the workpiece are stamped so as to remove the burrs formed in the workpiece during the first step.

The solution, according to the invention, offers the advantage that the workpiece is produced in only one tool. Post-treatment and visual checking are eliminated. Another advantage is that placing in an intermediate position and transport are also eliminated.

In a development hereof, it is proposed that during a working operation in the fine blanking stage a first workpiece be blanked from the raw material and the burrs simultaneously removed in the stamping stage on a second workpiece. In another development of the invention, it is proposed that after terminating a working operation the first workpiece be automatically transported from the fine blanking stage to the stamping stage by means of transfer tongs. The second workpiece is simultaneously removed from the device and the fine blanking stage is equipped with a new raw material.

BRIEF DESCRIPTION OF THE DRAWING(S)

FIG. 1 diagrammatically illustrates the method of the present invention.

DESCRIPTION OF THE PREFERRED EMBODIMENT(S)

The reference numeral 1 shows the device. The device 1 consists of a fine blanking stage 2, transport tongs 4 and stamping stage 3. In the blanking stage 2, the workpiece 5 is blanked from raw material. In the drawings, the workpiece 5 is designed in cross section as one plate. In this first method step, burrs 6 form on the plate 5 both on the inner and outer contours. In this condition, the plate 5 cannot be used without post-treatment. After the first step, the plate 5 is passed by the transfer tongs 4 from the fine blanking stage 2. Inside the device 1, the transfer tongs 4 automatically transport the finely blanked plate 5 to the stamping stage 3. In the stamping stage 3, the burrs of the plate 5 are stamped in the second method step, in other words, the outer and inner contours of the plate 5 are rounded. In FIG. 1, this is shown with the reference numeral 7. The stamping stage 3 consists of an upper die 8 and a lower die 9. The plate 5 thus produced is ready for installation without any further working operations. A high quantity of processed workpieces is obtained by simultaneously processing during one working operation inside the device 1, a first plate in the fine blanking stage 2 and a second plate within the stamping stage 3. After terminating said operations, the first plate, as described above, is brought out of the fine blanking stage to the stamping stage 3. The second plate completely processed in the stamping stage 3 is simultaneously removed from the tool.

Let it be pointed out that this method and the device are not limited to the production of plates. The method and the device can be used in general for producing stamped parts.

| Reference numerals |
|---|
| 1 device |
| 2 fine blanking stage |
| 3 stamping stage |
| 4 transfer tongs |
| 5 workpiece |
| 6 burrs |
| 7 stamped burr |
| 8 upper die |
| 9 lower die |

What is claimed is:

1. A method for producing entirely finished stamped parts solely by a two step process in a single device, the method consisting of the steps:

a) fine blanking a complete part including inner and outer contours of the complete part (5) from raw material in a fine blanking stage (2) of the device (1); and b) stamping said inner and outer contours of said complete part (5) in a stamping stage (3) of the device by contacting the complete part in a single direction with a die to eliminate burrs (6) formed on said complete part (5), during the fine blanking of the complete part (5), whereby said complete part (5) is entirely finished and requires no further treatment.

2. The method according to claim 1, further comprising the steps of simultaneously first complete part (5), from raw material during the fine blanking stage (2), and stamping of a second complete part during the stamping stage (3).

3. The method according to claim 2, further comprising the steps of, upon termination of said simultaneous steps, transporting said first complete part (5) inside said device (1) by means of transfer tongs (4) to the stamping stage (3), and concurrently therewith removing the second complete part from said device (1) and placing new raw material, for fine blanking a further complete part, in the fine blanking stage (2).

4. The method according to claim 1, further comprising the step of producing, during said stamping stage (3), said entirely finished complete part by stamping the inner and outer contours of said complete part between an upper die (8) and a lower die (9).

* * * * *